US005902953A

United States Patent [19]

Lenko et al.

[11] Patent Number: 5,902,953

[45] Date of Patent: May 11, 1999

[54] MINIATURE, LOW POWER, ELECTROMECHANICAL SAFETY AND ARMING DEVICE

[75] Inventors: Daniel S. Lenko, Monrovia; Thomas P. Frederick, Beltsville, both of Md.

[73] Assignee: The United States of America as represented by the Secretary of the Navy, Washington, D.C.

[21] Appl. No.: 07/853,221

[22] Filed: Mar. 16, 1992

[51] Int. Cl.[6] ..... F42C 15/188

[52] U.S. Cl. ..... 102/260; 102/255; 102/262

[58] Field of Search ..... 102/262, 254, 102/222, 255, 258, 260

[56] References Cited

U.S. PATENT DOCUMENTS

| | | | |
|---|---|---|---|
| 2,954,734 | 10/1960 | Kendall et al. | 102/255 |
| 2,994,272 | 8/1961 | Saunderson | 102/262 |
| 3,311,058 | 3/1967 | Fohrmann et al. | 102/254 |
| 4,675,480 | 6/1987 | Jones | 102/262 |
| 4,722,277 | 2/1988 | Sundvall et al. | 102/255 |

FOREIGN PATENT DOCUMENTS

| | | | |
|---|---|---|---|
| 2563622 | 10/1985 | France | 102/254 |

*Primary Examiner*—Stephen M. Johnson
*Attorney, Agent, or Firm*—John Forrest; Jacob Shuster

[57] ABSTRACT

The blocking disc serving as an explosive train interrupter of a safety and arming mechanism is angularly displaced from its safe position by a stepping motor through reduction gearing in response to timed energizing pulses applied thereto from a crystal-controlled pulse generator. The blocking disc is releasably latched in its safe position by a locking rod controlling the supply and cut-off of energizing voltage to the pulse generator to accurately time displacement of the disc to an armed position.

1 Claim, 3 Drawing Sheets

MINIATURE, LOW POWER, ELECTROMECHANICAL SAFETY AND ARMING DEVICE

BACKGROUND OF THE INVENTION

This invention relates generally to safety arming devices for ordnance involving use of an explosive train interrupter to prevent inadvertent detonation of an explosive charge.

Various timing mechanisms are presently known involving spring-driven clockwork units, fluid timers or electronic delay devices for establishing safe separation time through an explosive train interrupter, precluding premature propagation between primary and secondary explosives. One popular mechanical type of explosive train interrupter involves uses of a rotatable blocking disc as disclosed for example in U.S. Pat. Nos. 2,960,037, 3,425,353, 4,389,937 and 4,603,635 to Raech, Jr. et al., Halling, Golay et al. and Boudreau, respectively. According to each of the latter patents, the blocking disc is spring driven to an armed position upon release from its latched safety position. Such mechanical interrupters are however characterized by relatively rapid and uncontrolled displacement of the blocking disc, more suitable for remotely delivered ordnance where timing accuracy is not particularly critical. As to the timing mechanisms heretofore utilized to achieve safe separation time as aforementioned, they are susceptible to temperature variations, as well as being relatively costly.

It is therefore an important object of the present invention to provide a less costly and more reliably accurate explosive train interrupter that is particularly suitable for manual or hand emplaced ordnance.

SUMMARY OF THE INVENTION

In accordance with the present invention the blocking disc of an explosive train interrupter is driven by an electrically energized drive module featuring a miniature type of stepping motor drivingly connected through reduction gearing to the blocking disc for regulated rotation thereof accurately timed by supply of motor energizing pulses from a crystal-controlled pulse generator to initiate and terminate angular displacement of the blocking disc between its safe and armed positions.

Series connected switches interconnect a battery source of voltage with the pulse generator to supply the energizing pulses to the stepping motor. One of such switches is closed in response to manual displacement of a locking rod from a disc latching position against a spring bias to initiate said rotation of the blocking disc. The other of the switches is opened in response to arrival of the blocking disc at its armed position to deenergize the pulse generator and thereby promptly terminate rotation of the blocking disc. Rotation of the blocking disc between such positions is regulated by frictional rotational resistance and pulsation of the driving torque applied by the stepping motor through the reduction gearing of the drive module to the blocking disc with a high mechanical advantage.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF THE PREFERRED EMBODIMENT

Figure 1:
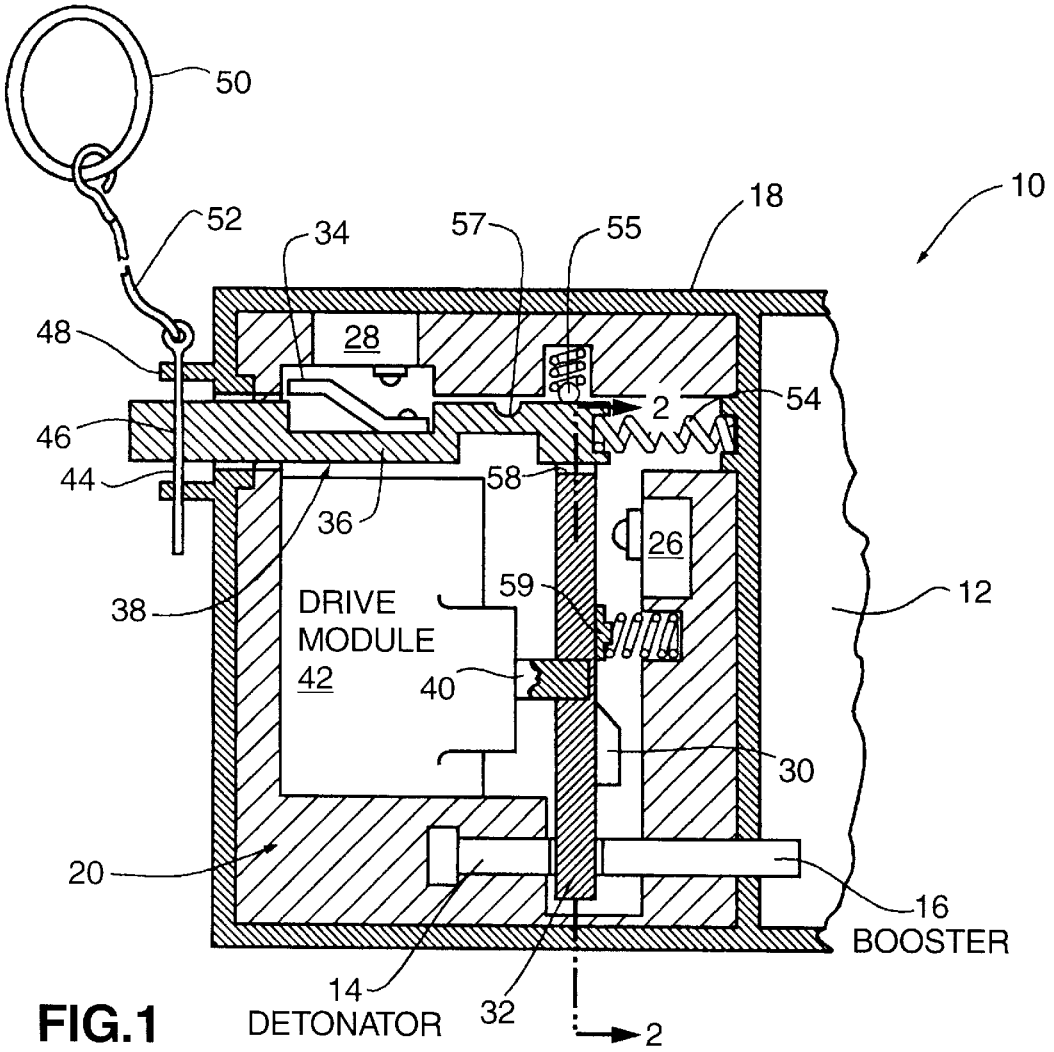
FIG. 1 is a partial side section view of an ordnance device showing the safety arming mechanism associated therewith in a safe position in accordance with one embodiment of the invention.

Referring now to the drawing in detail, FIG. 1 illustrates a hand emplaced ordnance generally referred to by reference numeral 10 having an explosive charge 12 to which an explosive initiation train is established from an electric detonator 14 through a lead or booster 16. The ordnance housing 18 enclosing the charge 12 also encloses a safety arming mechanism generally to by reference numeral 20 in FIG. 1, with which the detonator 14 is associated.

Figure 3:
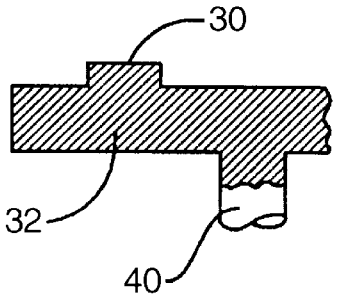
FIG. 3 is a partial section view taken substantially through a plane indicated by section line 3—3 in FIG. 2.
Figure 4:
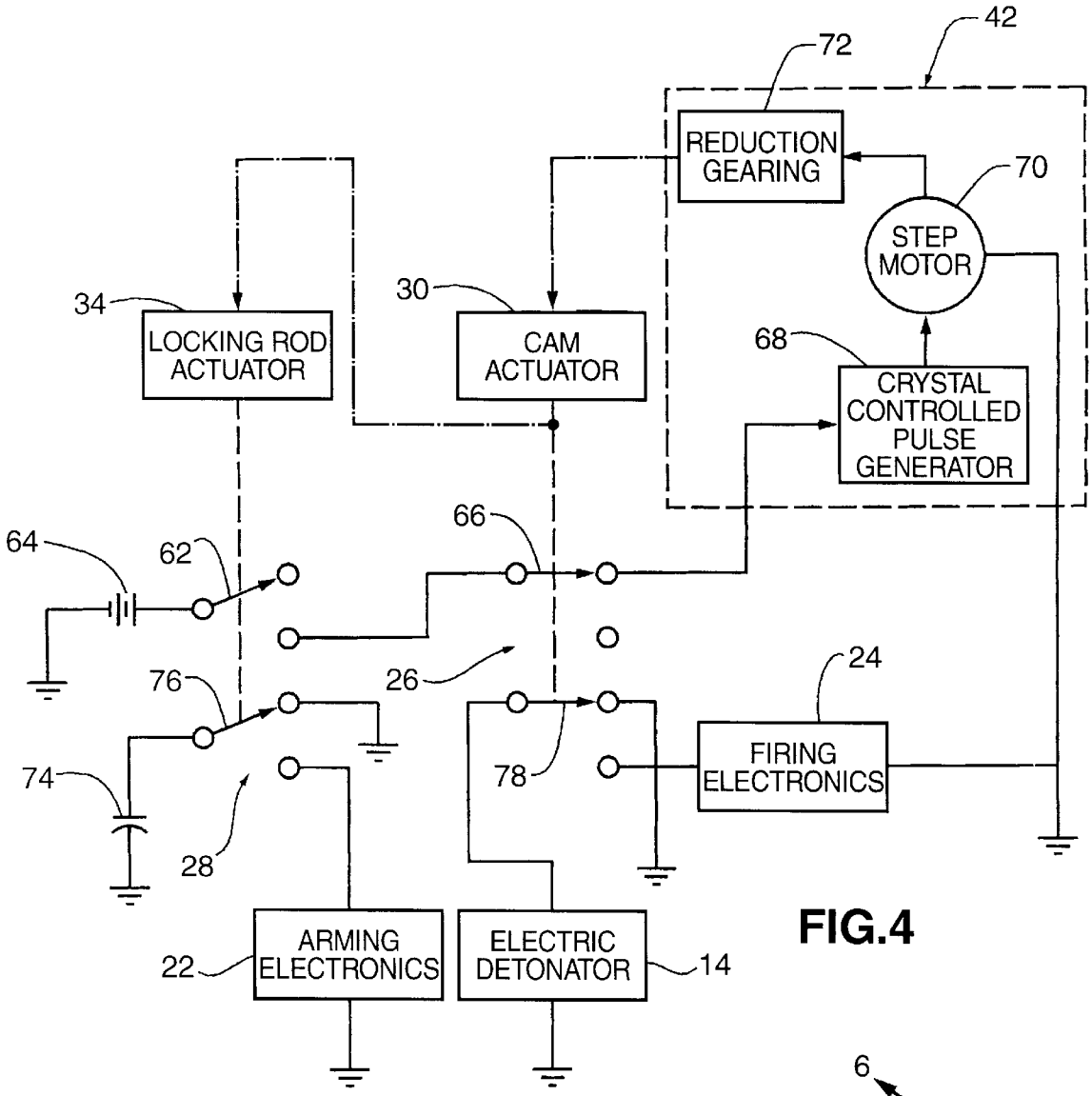
FIG. 4 is schematic and electrical circuit diagram illustrating the system associated with the apparatus shown in FIGS. 1, 2 and 3.

The safety arming mechanism 20 also has associated therewith, according to certain installational embodiments of the present invention, arming electronics 22 and firing electronics 24, as diagrammed in FIG. 4, subject to the control of series connected switch assemblies 26 and 28. The switch assembly 26 is operated by a cam actuator formation 30 carried on one axial face of an interrupter in the form of a blocking disc element 32 as shown in FIGS. 1 and 3. The switch assembly 28, on the other hand, is operated by an actuator element 34 fixed to an elongated locking rod 36 of a latch mechanism 38. The blocking disc 32 is angularly displaced about the axis of its shaft 40 by a drive module 42 as shown in FIG. 1 and diagrammed in FIG. 4.

Figure 1A:
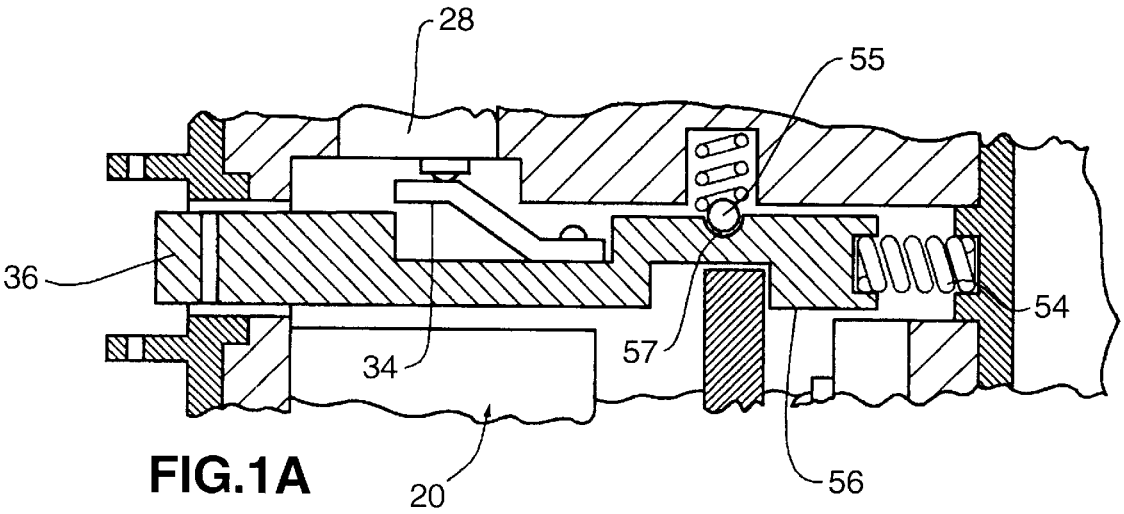
FIG. 1A is a side section view of a portion of the device shown in FIG. 1 displaced from its safe position.

The locking rod 36 of the latch mechanism 38 is shown in FIG. 1 in its initial latching position holding the blocking disc 32 in its safe position. The locking rod is reliably held in its latch position by a cotter pin 44 inserted through a transverse bore 46 in the pin aligned with holes in lugs 48 projecting from the housing 18. The cotter pin 44 may be manually withdrawn by means of a pull ring 50 connected to the pin by a lanyard 52. The locking rod 36 may then be manually pushed inwardly into the housing 18 against the bias of a spring 54 to a release position in which it is held by a spring-biased ball lock 55 received in a notch 57 formed in the rod 36 as shown in FIG. 1A.

Figure 2:
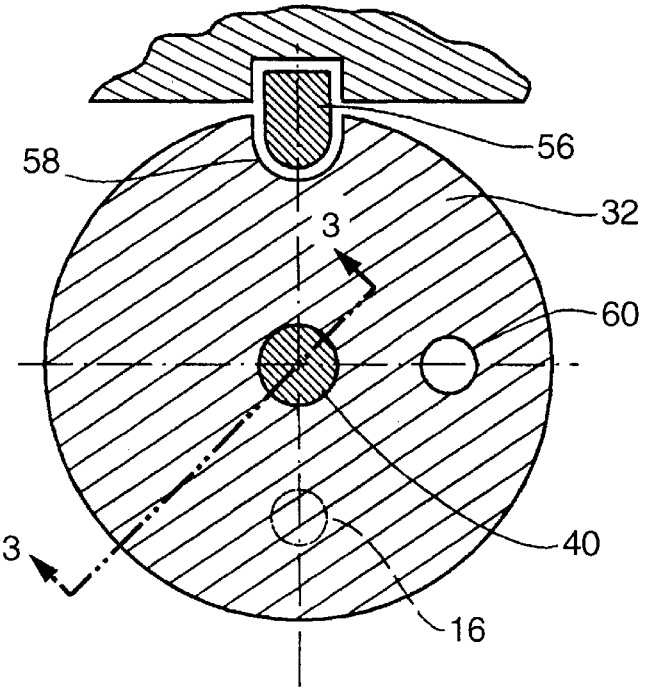
FIG. 2 is a partial section view taken substantially through a plane indicated by section line 2—2 in FIG. 1.

The spring 54 is in engagement with an inner latch formation 56 on the locking rod received within a peripheral notch 58 holding the blocking disc 32 in its safe position as shown in FIGS. 1 and 2. In such safe position, the blocking disc 32 prevents the detonator 14 from acting on the booster 16 thereby interrupting the explosive initiation train. When the disc 32 is angularly displaced by a predetermined angle to an armed position, an opening 60 formed therein, as shown in FIG. 2, is aligned between the detonator 14 and booster 16 to enable initiation of charge 12 by operation of the electric detonator 14. As the disc 32 reaches such armed position, the cam actuator formation 30 actuates the switch assembly 26 to terminate disc movement.

Angular displacement of the blocking disc 32 from the safe position occurs when the latch formation 56 at the inner end of locking rod 36 is axially displaced from the notch 58 to a release position against the bias of spring 54 as aforementioned. A spring-biased friction pad 59 bears against disc 32 to exert frictional resistance thereon as shown in FIG. 1, to prevent inadvertent angular displacement. During axial displacement of the locking rod 36 to the release position, the switch assembly 28 is actuated by actuator 34 to initiate displacement of the blocking disc 32 by the drive module 42.

Actuation of the switch assembly 28 by actuator 34 closes a normally open switch 62 thereof as diagrammed in FIG. 4 connecting a source of DC voltage 64, such as a 1.5 volt battery, to the drive module 42 through a normally closed switch 66 of the switch assembly 26 electrically connected in series with switch 62. The drive module 42 according to the embodiment diagrammed in FIG. 4, includes a pulse generator 68 that is crystal driven at 32.768 KHz for example when energized by the voltage source 64 through switches 62 and 66. Timed pulses of alternating polarity are thereby applied at a rate of one pulse per second, for example, to a miniature stepping motor 70 of the module through which relatively low intermittent output driving force or torque is produced. Through reduction gearing 72 as diagrammed in FIG. 4, the motor 70 rotates the blocking disc 32 at a mechanical advantage of at least 450 (450 motor revolutions per 90° rotation of disc 32) to overcome the frictional regulating resistance aforementioned for precisely timed angular displacement of the blocking disc 32. In the armed position of the blocking disc, the cam actuator 30 mounted thereon opens the switch 66 in the switch assembly 26 to interrupt the supply of energizing voltage to the drive module 42 causing deenergization thereof and immediate cessation of angular displacement of the blocking disc. The foregoing actuation of switch assembly 26 also displaces switch 78 to a position connecting electric detonator 14 to firing electronics 24.

As an additional safety measure, operation of the electric detonator 14 may be disabled when the locking rod 36 is in its initial latch position by grounding of a fire capacitor 74, usually associated with the detonator, through a disconnect switch 76 of the switch assembly 28. Further, the detonator is also disabled in the safe position of the blocking disc 32 by grounding, through switch 78 of the switch assembly 26, and by disconnection of the detonator from its firing electronics 24 as diagrammed in FIG. 4.

Figure 6:
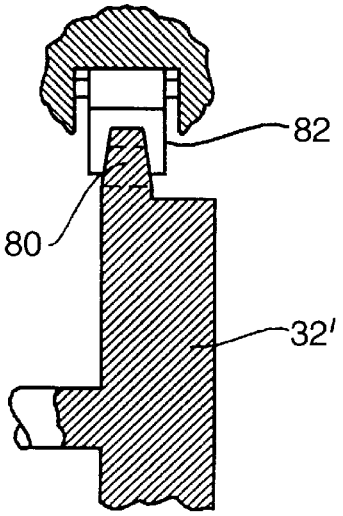
FIG. 6 is a partial section view taken substantially through a plane indicated by section line 6—6 in FIG. 5.
Figure 5:
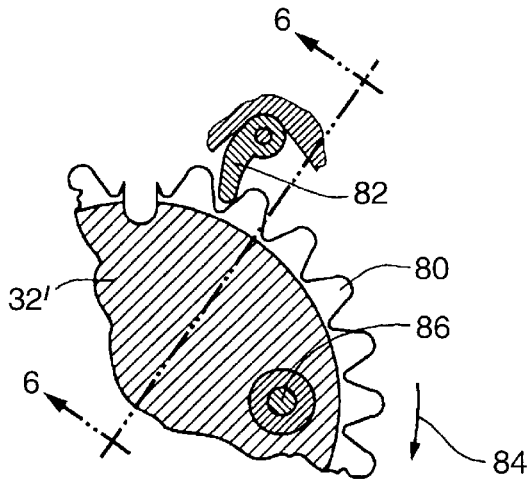
FIG. 5 is a partial section view corresponding to FIG. 2 showing modifications of the device in accordance with alternative embodiments of the invention.

FIGS. 5 and 6 illustrate certain alternative embodiments wherein a rotatable blocking disc 32', generally similar in function and arrangement to blocking disc 32 hereinbefore described, is formed with external gear teeth 80 associated with the reduction gearing through which disc 32' is drivinglyconnected to the stepping motor of the drive module. Rotational regulation for the disc 32' is provided by a one-way ratchet pawl 82. The pawl 82 is pivotally displaceable against a spring bias in a clockwise direction as viewed in FIG. 5 to unidirectionally limit angular displacement of disc 32' in the clockwise direction indicated by arrow 84 as well as to yieldably resist rotation in such direction. Thus, in the event of failure of the reduction gearing, inadvertent angular displacement of disc 32' to its armed position will be prevented with additional insurance.

FIG. 5 illustrates yet another alternative feature wherein the opening 60 associated with blocking disc 32 is replaced by a conductive detonation transfer element 86 adapted to be aligned between the detonator 14 and booster 16 of the explosive ignition train in the armed position of the blocking disc 32'.

Numerous other modifications and variations of the present invention are possible in light of the foregoing teachings. It is therefore to be understood that within the scope of the appended claims the invention may be practiced otherwise than as specifically described.

We claim:

1. In a safety arming device for ordnance having a charge, a detonator and an explosive train between the detonator and the charge, an explosive train interrupter comprising a blocking element displaceable between safe and armed positions, a drive module connected to the blocking element and latch means engageable with the blocking element for releasably holding the same in the safe position, said drive module including a stepping motor, pulse generating means connected to the motor for applying timed energizing pulses thereto producing intermittent drive forces and reduction gear means drivingly connecting the motor to the blocking element for transmitting said drive forces thereto at a mechanical advantage.

* * * * *